US005671858A

United States Patent [19]

Hsu

[11] Patent Number: 5,671,858

[45] Date of Patent: Sep. 30, 1997

[54] COLLAPSIBLE LAUNDRY CONTAINER STRUCTURE

[75] Inventor: Peyson Hsu, Changhua Hsien, Taiwan

[73] Assignee: Ching Feng Blinds Co., Ltd., Changhua Hsien, Taiwan

[21] Appl. No.: 712,472

[22] Filed: Sep. 11, 1996

[51] Int. Cl.[6] ..... B65D 33/00

[52] U.S. Cl. ..... 220/9.2; 220/401

[58] Field of Search ..... 220/9.2, 9.3, 6, 220/7, 401, 908

[56] References Cited

U.S. PATENT DOCUMENTS

| | | | |
|---|---|---|---|
| 608,998 | 8/1898 | Apthorp | 220/9.2 |
| 1,108,615 | 8/1914 | Paul | 220/9.2 |
| 1,133,648 | 3/1915 | Leary | 220/9.2 |
| 2,020,766 | 11/1935 | Brown | 220/9.3 X |
| 3,603,367 | 9/1971 | Lehrman | 220/9.3 |
| 4,646,802 | 3/1987 | Basore et al. | 220/401 |
| 4,921,196 | 5/1990 | Rudko | 220/401 X |
| 5,048,712 | 9/1991 | Wolters | 220/908 X |

*Primary Examiner*—Steven M. Pollard
*Attorney, Agent, or Firm*—Browdy and Neimark

[57] ABSTRACT

A collapsible laundry container structure having a base, an upper frame, a cover body, four supporting frames, six engaging members, and a water-proof bag is disclosed. The four supporing frames are engaged with the base and the upper frame by rivets to form two pairs of two-story supporting frames, and further fixed by the engaging members stopped with rececees and insert grooves disposed at one lateral side of each supporting frame so as to expand tightly and evenly the water-proof bag outside the supporting frames. In dismantling, the two-story supporting frames are pushed inward from outside the water-proof bag at the spot of the engaging members with the capacity of collapsible fold so as to fold and store the supporting frames neatly upon the base with the upper frame overlaid above. In addition, circular holes are disposed at the base to boost the circulation of air and a corrugated flange is provided at the bottom of the base to form a stable footing for supporting the base on the ground.

2 Claims, 5 Drawing Sheets

COLLAPSIBLE LAUNDRY CONTAINER STRUCTURE

TECHNICAL FIELD OF THE INVENTION

1. Background of the Invention

The present invention relates to a collapsible laundry container structure, comprising a base, an upper frame, a cover member, four supporting frames, six engaging means, and a water-proof bag. The four supporting frames, pivotally joined to the base and the upper frame and strenghtened by the six engaging-means with the capacity of collapsible fold, can be easily assembled into two pairs of two-story supporting frames expanding tightly and evenly the water-proof bag so as to boost the stability of the laundry container, or can be neatly dismantled and stored on the base with the upper frame overlaid on top.

2. Prior Art

Please refer to FIG. 1. A convention laundry container is comprised of a base 1, an upper frame 1, a cover body 3, four supporting columns 4, and a water-proof bag 5. The top face of the base 1 is provided with four arched flanges 6 disposed at the four corners thereon and four sloping blocks 7 corresponding to the four arched flanges 6, each arched flange 6 and sloping block 7 defining a receiving groove therebetween. In addition, a plurality of elongated slots 8 is disposed at the top surface of the base 1 and four arched footings 9 are provided, extending downwardly at the four corners of the base 1. The underside of the upper frame 2 is defined a frame groove 10 partitioned by a lower rib 11 into two sections. Moreover, the cover member 30 is attached to the rear of the upper frame 2 by hinge members, and each of the supporting columns 4 is formed as a semi-cylinder column.

Please refer to FIG. 2. In assembly, the water-proof bag is fastened to the outer flange of the upper frame 2 and the base 1 by both ends. The four supporting columns 4 are then inserted into the receiving grooves defined by the arched flanges 6 and the sloping blocks 7. And the upper ends of the supporting columns 4 are inserted into the four arched corners of the frame groove 10 of the upper frame 2 abutting against the end of the lower rib 11 thereof so as to spread open the water-proof bag 5.

Yet, there are several drawbacks in a conventional laundry container. First, it is difficult to assemble or dismantle. The water-proof bag 5 must be forcibly pulled upward or downward so as to assemble or dismantle the four supporting columns 4 to/from the receiving grooves thereof and the groove frame 10 of the upper frame 2. Besides, the supporting columns dismantled are scattered and hard to keep in storage. Second, space A is left open between the water-proof bag 5 and the four supporting columns 4 as shown in FIG. 2 making the four supporting columns weakly supported. Third, the four supporting columns are functionally inserted into the base 1 and the upper frame 2. Accordingly, the columns easily come off when a heavy load is applied thereto and moved therewith.

SUMMARY OF THE PRESENT INVENTION

It is, therefore, the primary object of the present invention to provide an improved laundry container structure, which can be easily assembled by rivets, engaging feet and engaging cavities and strengthened by six engaging means into two pairs of two-story supporting frames; and can be easily dismantled by pushing the two pairs of two-story supporting frames from outside of a water-proof bag at the spot of the engaging means with the capacity of collapsible fold, folding and storing the two-story supporting frames neatly upon a base with an upper frame overlaid above.

It is a further object of the present invention to provide a laundry container structure wherein the water-proof bag is tightly and evenly expanded by the two-story supporting frames with no space left open therebetween so as to further strengthen the supporting frames and improve the stability of the laundry container.

It is a third object of the present invention to provide a laundry container structure wherein the supporting frames strengthened by the tightly water-proof bag are fixedly assembled to the base and upper frame so that the supporting frames will not easily come off when carried and moved with a heavy load.

It is a fourth object of the present invention to provide a laundry container structure, having circular holes disposed at the top surface of the base defining a rectangular area to boost the circulation of air and a corrugated flange extending at the bottom of the base to form a stable footing for putting the laundry container on the ground.

DETAILED DESCRIPTION OF THE PREFERRED EMBODIMENTS

Figure 1:
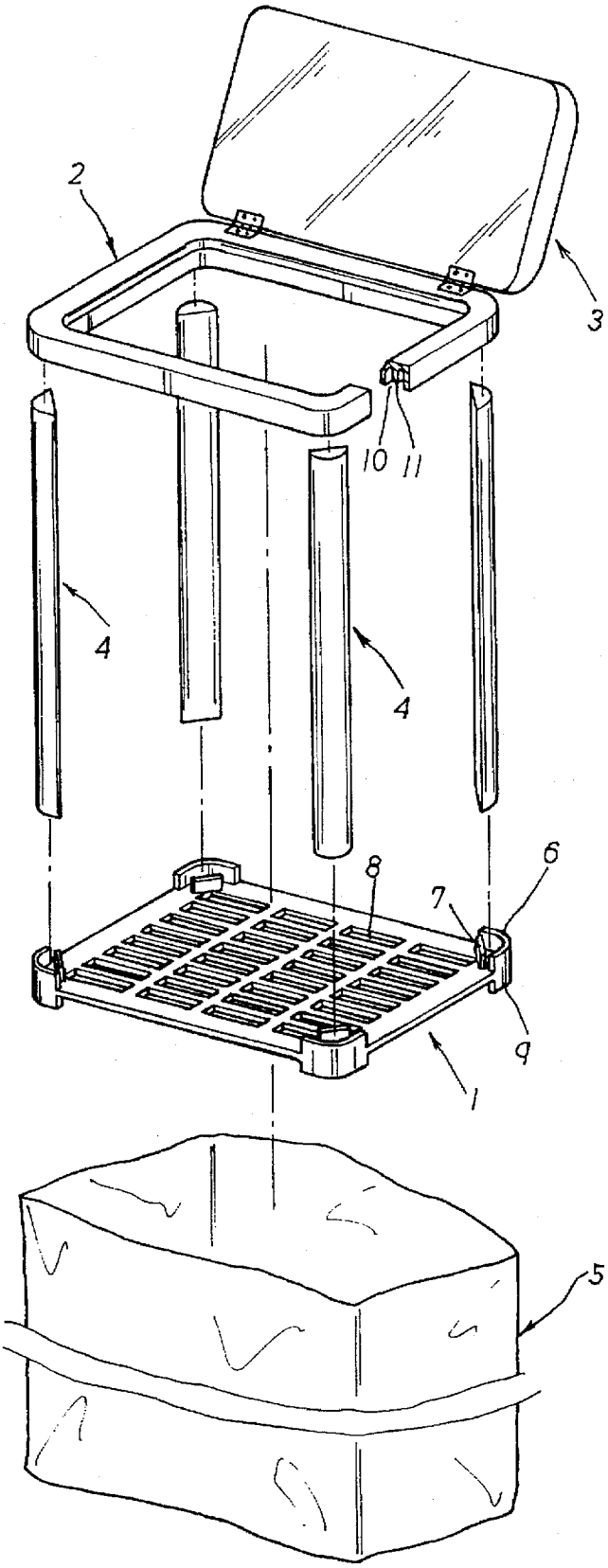
FIG. 1 PRIOR ART
FIG. 1 is a perspective exploded view of a conventional laundry container.
Figure 2:
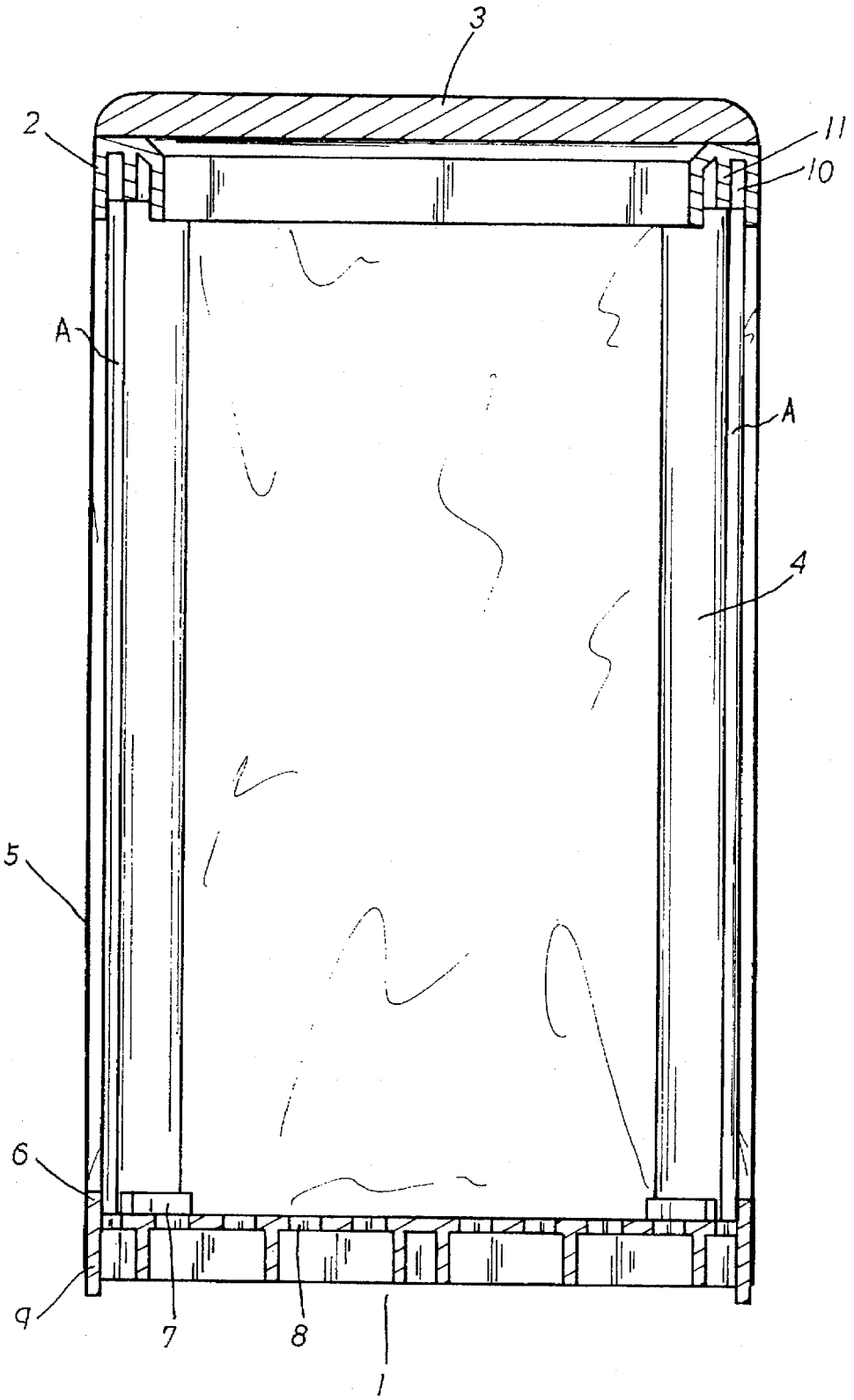
FIG. 2 PRIOR ART
FIG. 2 is a sectional view of the conventional laundry container of FIG. 1 in assembly.
Figure 3:
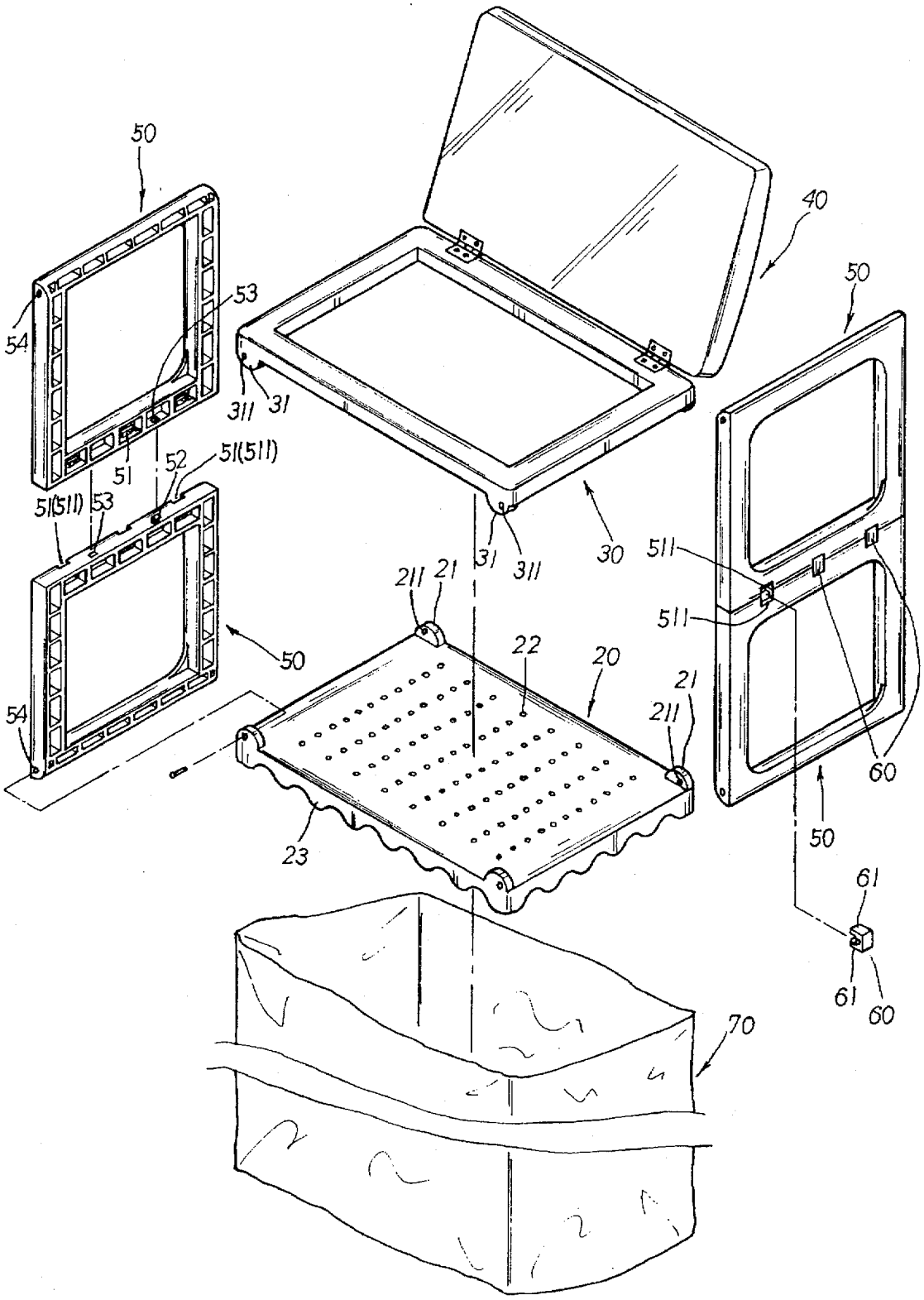
FIG. 3 is a perspective exploded view of the present invention.

Please refer to FIG. 3. The present invention relates to an improved laundry container structure, comprising a base 20, an upper frame 30, a cover member 40, four supporting frames 50, six engaging means 60, and a water-proof bag 70. At the four corners of the top surface of the base 20 are disposed four arch-shaped pivot members 21, each having a rivet hole 211 disposed on the lateral face thereof. Circular holes 22 are disposed and arranged at the top surface of the base 20, defining a rectangular area, and corrugated flange 23 is provided at the bottom of the base 20, extending downwardly to form a stable footing for putting the base 20 thereof on the ground. The four corners of the upper frame 30 likewise are provided with four arch-shaped pivot members 31, each having a rivet hole 311 disposed on the lateral face thereof.

Each of the four supporting frames 50 is provided with three equidistant insert grooves 51 at one lateral side; whereby three recesses 511 are disposed at the flange of the lateral side corresponding to the three equidistant insert grooves 51. An engaging foot 52 and an engaging cavity 53 are provided alternatively among the three equidistant insert grooves 51. And two rivet holes 54 are disposed at two arched corners of one lateral side of the supporting frame 50. Each of the six engaging means 68 can be flexibly doubled, having two engaging feet 61 extending from both lateral sides of the engaging means 60 thereof. In addition, the cover member 40 is attached to the rear of the upper frame 30 by hinge members.

Figure 4A:
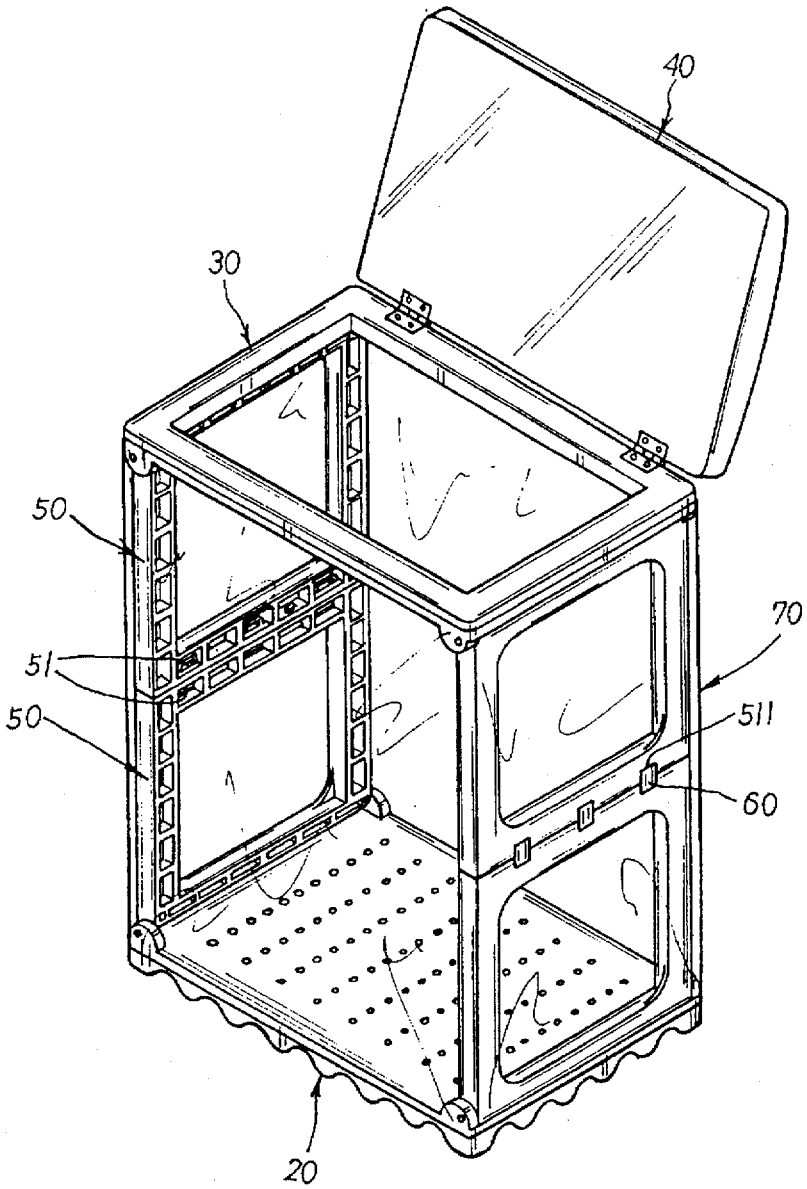
FIGS. 4A, 4B, 4C are perspective assembled and partially assembled sectional views of the present invention.
Figure 4B:
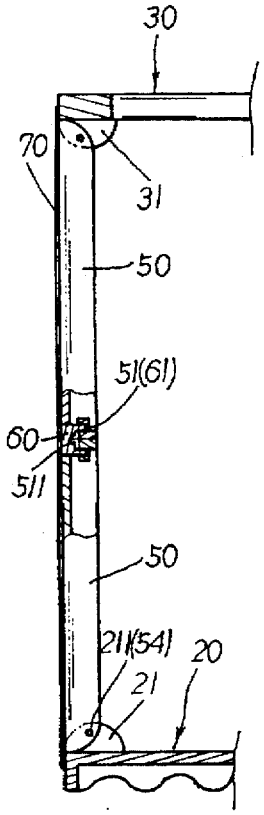
Figure 4C:
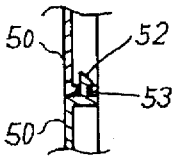

Please refer to FIGS. 4A 4B 4C. In assembly, the four supporting frames 50 are pivotally joined with the base 20 and the upper frame 30 by rivets passing and joining the rivet holes 54 disposed at the arched corners of the supporting frame 50 and the rivet holes 211, 311 disposed at the arch-shaped pivot members 21, 31 of the base 20 and the upper frame 30 respectively so as to form two pairs of two-story opposite supporting frames 50. The water-proof bag 70 is then applied and fastened to the outer flange of the upper frame 30 and the base 20 by both ends, and each two-story supporting frames 50 further fixed by inserting the engaging feet 52 disposed at both upper and lower stories respectively to the engaging cavities at both stories thereof, locating the two-storied supporting frames 50 in a vertical plane and expanding tightly and evenly the water-proof bag 70 outside the supporting frames 50. The six engaging means 60 are then adapted to strengthen the two pairs of two-story supporting frames 50, each stopped within the opening formed by the recesses 511 of the engaged upper and lower supporting frames 50 with the engaging feet 61 of the engaging means 60 inserted to the insert grooves 51 of the upper and lower supporting frames 50 respectively.

Figure 5:
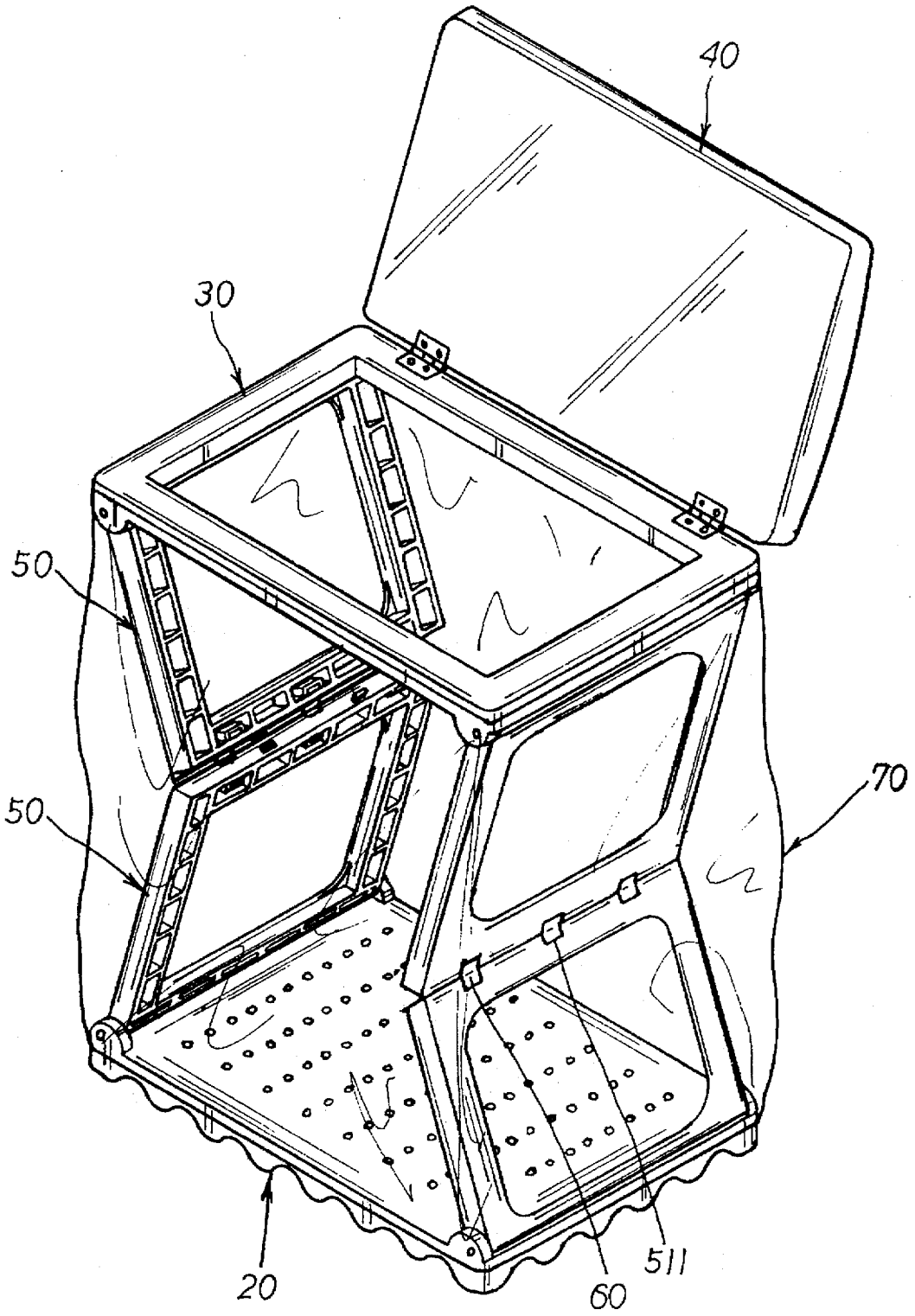
FIG. 5 is an operational view of the present invention while being dismantled and stored.

Please refer to FIG. 5. To dismantle the present invention, the two-story supporting frames 50 are pushed inward from outside the water-proof bag 70 at the spot of the engaging means 60, causing the engaging means 60 to collapse and fold with the engaging feet 52 thereof detaching from the engaging cavities 53 of the supporting frames 50 thereof. And, by means of the rivet holes 54 disposed at the arched corners of the supporting frames 50 and pivotally joined to the base 20 and the upper frame 30 respectively, the two-story supporting frames 50 can be folded up and stored on the base 20 with the upper frame 30 overlaid on top.

Thus, there are several benefits to the present invention. First, the assembly and dismantling of the present invention is quite simple and easy and the storage quite tidy and neat. Second, the water-proof bag 70, evenly expanded by the supporting frames 50, can consequently strengthen the supporting frames 50 and boost the stability and the load resistance of the container thereof. Third, the supporting frames 50 strengthened evenly by the water-proof bag 70 are tightly engaged with the upper frame 30 and base 20 so that the assembly will not easily come off when moved. Fourth, the circular holes 22 disposed at the top surface of the base 20 help boost the circulation of air and the corrugated flange 23 disposed at the bottom of the base 20 help stabilize the laundry container on the ground.

What is claimed is:

1. A collapsible laundry container structure, comprising:

a base, an upper frame, a cover body, four supporting frames, six engaging means, and a water proof bag, wherein, the cover body is attached to a rear of the upper frame by hinge members, and opposite ends of the water-proof bag are respectively adapted to be fastened to an outer flange of the base and a periphery of the upper frame;

the base is provided with four first pivot members disposed at four corners of a top surface thereof, a rivet hole disposed in a lateral face of each of the four first pivot members;

the upper frame is provided with four second pivot members disposed at four corners of an underside thereof, a rivet hole disposed in a lateral face of each off the four second pivot members;

each of the four supporting frames is equipped with three equidistant insert grooves at a first lateral side; wherein, three recesses are disposed at a flange of the first lateral side thereof corresponding to the three equidistant insert grooves, and an engaging foot and a engaging cavity are alternatively disposed between the three equidistant insert grooves, and two rivet holes are disposed at a second lateral side;

each of the six engaging means is provided with two engaging feet extending from both lateral sides thereof which permit a collapsible fold;

a first pair of the the four engaging frames are engaged with the base and a second pair of the four engaging frame are engaged with the upper frame respectively via rivets respectively passing through the rivet holes correspondingly disposed at the second lateral side the supporting frames and the rivet holes in the lateral face of the first pivot members and the second pivot members;

each engaging foot and engaging cavity of the first pair of the four engaging frames are alternatively joined to a correspondingly engaging cavity and engaging foot on the second pair of four engaging frames to form two vertical plates; the engaging means being engaged in the openings formed by the recesses by abutting frames of each of the two vertical plates and the engaging feet of the engaging means engaged in the insert grooves of the abutting frames to complete the assembly of the laundry container; wherein the water-proof bag engaged to the base and the upper frame is tightly and evenly expanded outside the two vertical plates to strengthen the assembly of the abutting frames and the base and upper frame; and wherein when dismantling the two vertical plates frames the engaging means are pushed from outside the water-proof bag so as to fold and store the abutting frames neatly upon the base with the cover body overlaid above.

2. A laundry container structure as claimed in claim 1, wherein, circular holes are disposed at a top surface of the base, defining a rectangular area so as to facilitate the circulation of air; and corrugated flanges are disposed on a bottom of the base, extending downwardly to form a stable footing for supporting the base on the ground.

* * * * *